US006230812B1

(12) United States Patent
Reaux

(10) Patent No.: US 6,230,812 B1
(45) Date of Patent: May 15, 2001

(54) SIDE POCKET MANDREL

(76) Inventor: James Reaux, 130 Industrial Blvd., Sugar Land, TX (US) 77478

( * ) Notice: Subject to any disclaimer, the term of this patent is extended or adjusted under 35 U.S.C. 154(b) by 0 days.

(21) Appl. No.: 09/068,094

(22) PCT Filed: Sep. 5, 1996

(86) PCT No.: PCT/US96/14201

§ 371 Date: May 1, 1998

§ 102(e) Date: May 1, 1998

(87) PCT Pub. No.: WO97/18381

PCT Pub. Date: May 22, 1997

Related U.S. Application Data

(60) Provisional application No. 60/003,663, filed on Nov. 15, 1995.

(51) Int. Cl.[7] ..... E21B 23/03

(52) U.S. Cl. ..... 166/378; 166/117.5

(58) Field of Search ..... 166/65.1, 117.5, 166/378, 380, 250.11, 66

(56) References Cited

U.S. PATENT DOCUMENTS

| | | | | |
|---|---|---|---|---|
| 3,939,705 | | 2/1976 | Glotin et al. . | |
| 4,105,279 | | 8/1978 | Glotin et al. . | |
| 4,333,527 | | 6/1982 | Higgins . | |
| 4,416,330 | | 11/1983 | Merritt . | |
| 4,505,331 | | 3/1985 | Akkerman . | |
| 4,624,309 | * | 11/1986 | Schnatzmeyer | 166/66 |
| 4,722,393 | * | 2/1988 | Rumbaugh | 166/217 |
| 5,236,047 | * | 8/1993 | Pringle et al. | 166/369 |
| 5,355,952 | * | 10/1994 | Meynier | 166/250 |

FOREIGN PATENT DOCUMENTS

| | | |
|---|---|---|
| 0106525 | 4/1984 | (GB) . |

* cited by examiner

*Primary Examiner*—Frank S. Tsay

(57) ABSTRACT

A side pocket mandrel for providing a top entry electrical connection from a bottom location in the mandrel comprised of cylindrically shaped parts (119*a*–119*g*) connected end to end to form an elongated housing having an offset full opening bore where said housing has 1) a laterally offset upper recess (167) in communication with the full opening bore for receiving a well tool (117) moved laterally from the full opening bore, 2) a lower laterally offset pocket bore (125*a*, 125*b*) for receiving the well tool, 3) a laterally offset lower recess (127), 4) at least one laterally offset, longitudinally extending and separately located pipe bore (140) extending alongside of the offset pocket bore for connecting the upper recess to the lower recess, and 5) at least one outlet bore (168) extending between the upper recess and the housing's exterior.

16 Claims, 13 Drawing Sheets

SIDE POCKET MANDREL

PRIOR APPLICATIONS

This application is based upon a provisional application accorded a filing date of Nov. 15, 1995 and serial No. 60/003663.

RELATED APPLICATIONS

This application is related to the disclosure in U.S. Pat. No. 5,457,988, issued Oct. 17, 1995 and entitled "Side Pocket Mandrel Pressure Measuring System".

This application is related to the disclosure in U.S. Pat. No. 5,455,573 issued Oct. 3, 1995 and entitled "Inductive Coupler For Well Tools".

FIELD OF THE INVENTION

This invention relates to side pocket mandrels for use in well tubing strings or production tubing in a well bore. More particularly this invention relates to side pocket mandrels and methods of construction thereof for use in coupling one or more electrical conductors from a side pocket mandrel to the earth's surface for obtaining real time downhole measurements and data.

BACKGROUND OF THE INVENTION

Side pocket mandrels are typically installed in a string of production tubing in a well bore. The mandrel is provided with a full opening bore which is aligned with the bore of the production tubing and with a laterally offset side pocket bore which receives a side pocket well tool. Side pocket well tools can be passed through the production tubing and are retrievably seated in the side pocket bore to perform or to monitor operations in the well bore or production tubing. A side pocket well tool is retrievable and can be seated and recovered from the offset bore by use of a kickover tool, or similar tool. Side pocket well tools heretofore typically have included flow control devices, gas-lift devices, chemical injection devices and so forth, for use in conventional production operations.

In a typical construction, the side pocket mandrel has a mandrel body section with the full opening bore and the body section is connected to forged upper and lower body sections by butt welds. To latch a tool in an offset side pocket bore, a valve latching lug or clamp is located in the mandrel body to cooperate with the side pocket well tool. Welding usually requires that the assembly be heat treated to relieve stress.

In some instances, a desire has been expressed to have an single wire electrical take out from a side pocket mandrel for data transmission to the earth's surface. This can be difficult because of welding and heat treatment which can destroy or adversely affect any electrical components. Further, even when separately installed, a bottom located electrical take out is difficult because the wire is easily damaged when the production string is moved through a well bore.

In the present invention the system for manufacturing a side pocket mandrel and its construction permits an electrical takeout at the top of the mandrel and/or the bottom of the mandrel and permits installation of an inductive coupling device in the lower end of the mandrel.

One purpose of an electrical takeout on a side pocket tool is to monitor the pressure of the fluids over a period of time as a function of real time by connection of a downhole pressure measurement tool with an electrical conductor extending to the earth's surface for data transmission. In present systems to obtain a real time pressure measurement, a pressure gauge is attached to the exterior of the string of tubing. The gauge, the tubing and an attached electrical conductor wire are located in a well bore. Should a problem arise with the tool or for any other reason which might require removal of the tool, the well must be killed and the gauge retrieved with the string of tubing. Obviously, this is expensive and time consuming.

A proposed system, such as described in the OTC paper 5920, 1989 entitled "A Downhole Electrical Wet Connection System For Delivery and Retrieval of Monitoring Instruments by Wireline" uses a side pocket mandrel and pressure gauge with a downhole "wet connector" for coupling power to a tool and for read out of data. "Wet connectors" in a high pressure, corrosive environment ultimately corrode. In making up the connection, it is often difficult to make connections because of mud or debris in the well bore. Moreover, brine in the fluid causes electrical shorting of circuits. In short, an electrical wet connector is not reliable and this is particularly true over a period of time.

In another type of system known as a "Data Latch" system, a battery powered pressure gauge is installed in a mandrel which has a bypass. A wireline tool with an inductive coil is latched in the bore of the mandrel while permitting a fluid bypass. The inductive coil on the wireline tool couples to a magnetic coil in the mandrel for obtaining a read out of real time measurements. The system does not provide downhole power to the tool and battery failure requires killing the well and retrieving the tool with the well string.

Inductive coupling devices are difficult to construct for a downhole environment and yet are extremely desirable devices for downhole tools as a replacement for the above systems. Moreover, a system for real time measurement and monitoring of pressure, flow velocity, and temperature on a more or less permanent basis is highly desirable.

SUMMARY OF INVENTION

In the present invention a side pocket mandrel is an integral assembly with a lower end section, a side pocket housing section, and an upper takeout section where said sections are seelingly interconnected and define a full opening bore in alignment with a longitudinal axis of a production tubing. The side pocket housing section has a full opening bore and an offset side pocket bore which is laterally offset with respect to the full opening bore. The side pocket bore is constructed and arranged to receive a side pocket well tool with a tool inductive coupling member and includes a guide channel above the side pocket bore.

The assembly includes a side pocket inductive coupling member fixed in the lower end of the offset side pocket bore to receive the tool inductive coupling member and to provide an inductive coupling relationship so that electrical power can be provided to a well tool in the side pocket bore and data transmission can be made from the well tool to the side pocket inductive coupling member. The full opening bore in the side pocket housing section is continued through the lower end housing section by a tubular member which defines a chamber between the outer wall of the tubular member and the inner wall of the end housing section.

The side pocket induction coupling member has an electrical wire disposed in a pliable tubing conduit which extends into the chamber and through a longitudinal bore in the side pocket housing. The longitudinal bore in the side pocket housing is coupled by a tubular longitudinally extending pipe member to a take out bore in the upper take out section. The tubing conduit extends through the pipe member and the take out bore and is connected to an electrical pressure connector at the upper end of the side pocket mandrel.

In assembly, the tubing conduit in the side pocket mandrel and the connected side pocket inductive coupling member are jointly shifted to move the side pocket inductor coupling member into the side pocket offset bore while moving the tubing conduit exterior to the take out housing. When the tubing conduit is exterior to the take out housing, the electrical pressure connector can be connected up to the tubing conduit. Then the tubing conduit and the connected side pocket inductive coupling member are jointly shifted to a position where the electrical pressure connector is pressure connected in the take out housing and the inductive coupling member is located in its operative position in the side pocket bore. The electrical connector is enclosed in a chamber by a tubular member which is located in the lower housing section. A threaded end member is sealingly attaches to the lower housing section and provides a continuation of the full opening bore with the tubular member.

The various sections of the side pocket mandrel can be connected by welds which can be heat treated independently of installation of the inductive coupling member so that the coupling member is not adversely affected by a heat treatment. In forming the welded joints, the adjacent ends to be welded are provided with an exterior welding chamfer and internal wall recesses. When welded together, the mating recesses provide a full flushing recess at each welded connection.

DESCRIPTION OF THE INVENTION

Figure 1:
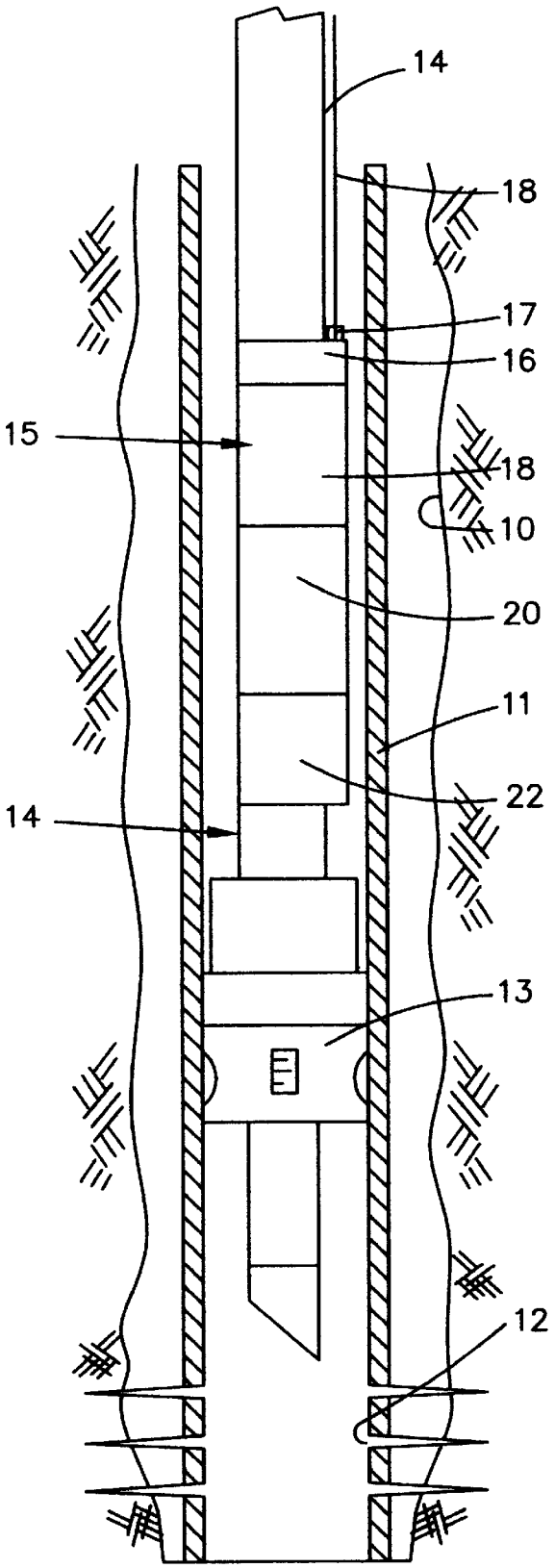
FIG. 1 is a schematic view in cross-section through a well bore containing a production packer and a side pocket mandrel with a pressure group.

Referring now to FIG. 1, a well bore is illustrated schematically where a well bore 10 transverses earth formations and where a liner 11 is cemented in place. Production fluids are produced through perforations 12 in the well liner and direct through a tail pipe on a production packer 13 to a string of tubing 14 for travel to the earth's surface. Along the length of the string of tubing are one or more side pocket mandrels 15 which are constructed and arranged according the present invention to internally receive a retrievable side pocket well tool such as a pressure gauge 16 (shown in FIG.2). The pressure gauge 16, when installed in a side pocket mandrel 15, has an inductive coupling member positioned relative to an inductive coupling member in the side pocket mandrel 15 to be inductively powered and to passively transmit pressure data from the pressure gauge to the inductive coupling member in the side pocket mandrel. Other side pocket devices can be employed where data or control functions are transmitted from the earth's surface to a downhole tool. The inductive coupling member in the side pocket mandrel is connected by an upper electrical takeout at 17 to a conductor cable 18 in an external conduit which extends to the surface of the earth for a surface read out and recording of the downhole data on a real time basis.

Figure 2:
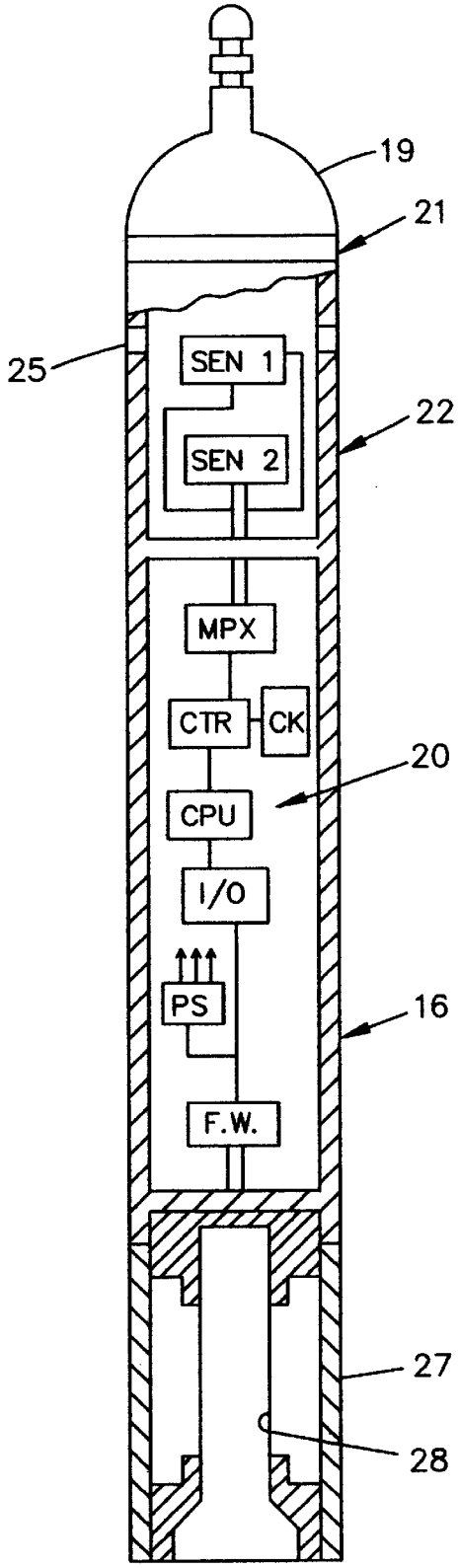
FIG. 2 is a schematic view of a pressure gauge which can be utilized with the present invention.
Figure 8:
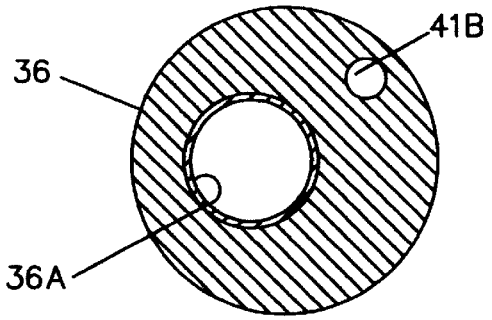
FIG. 8 is a view in cross-section taken along line 8—8 of FIG. 3.
Figure 7:
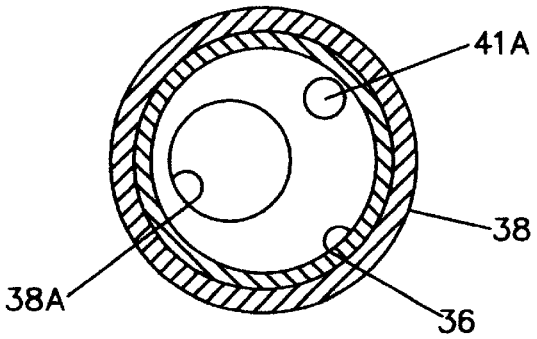
FIG. 7 is a view in cross-section taken along line 7—7 of FIG. 3.

Referring now to FIG. 2, the pressure gauge 16 is sized for insertion through a string of tubing on the end of a wire line cable. A wire line cable with a side pocket positioning device (not shown) is attached to the well tool by a conventional releasable coupler 19. A typical O.D. of the pressure gauge is 1.5 inches or less. The tool contains an electronics section 20 for electrically processing and powering the instrumentation, a temperature sensor section 21 for sensing temperature and a pressure sensor section 22 for sensing pressure or flow. An opening 25 admits pressure to the pressure sensors in the pressure sensor section 22. At the lower end of the tool is an inductive coupler section 27 with a socket member 28.

Figure 3:
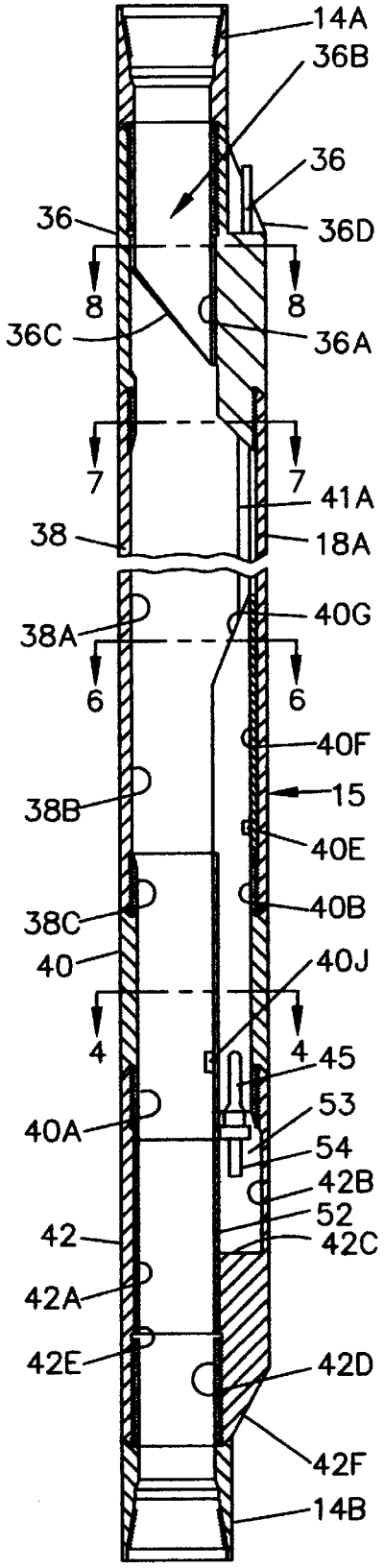
FIG. 3 is a view in longitudinal cross-section through the side pocket mandrel and housing using an inductive coupling probe member and an upper electrical take out.

Referring now to FIG. 3, a side pocket mandrel 15 is illustrated as interconnected between adjacent tubing pup joints or sections 14A and 14B of a string of tubing or production tubing 14 so as to form a part of the string of tubing.

The side pocket mandrel 15 is generally an elongated cylindrically shaped member formed by four sections or parts comprising, from top to bottom, respectively, an upper takeout housing part 36, a body pipe part 38, a side pocket housing part 40, and a lower housing part 42. Each mandrel part 36, 38, 40, 42 respectively has aligned full opening bores 36A, 38A, 40A, and 42A which are equal or larger than the bore of the production tubing 14. The full opening bores extend through the length of mandrel 15 so that the mandrel 15 has an effective full opening bore. The effective full opening bore permits wireline side pocket well tools and other small diameter tools to pass through mandrel 15 to locations below and in the mandrel 15.

Figure 4:
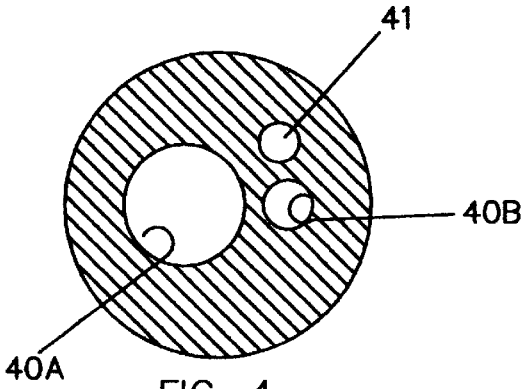
FIG. 4 is a view in cross-section taken along line 4—4 of FIG. 3.

In the side pocket housing part 40, a side pocket bore 40B is located generally parallel to and laterally offset from the full opening bore 40A. The side pocket bore 40B is sized to receive a pressure gauge 16 or other side pocket tool. The bores 40A and 40B may be more clearly seen in the cross-section of the housing part 40 as illustrated in FIG. 4.

Figure 5:
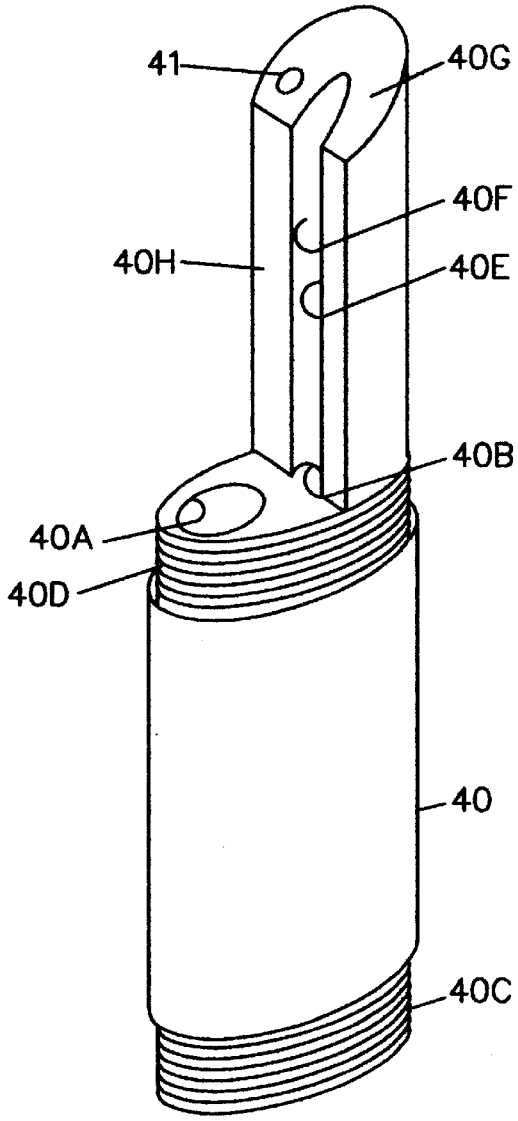
FIG. 5 is a perspective view of the side pocket housing part of the present invention.

Referring to FIG. 3 and FIG. 5, the configuration of the side pocket housing part 40 may best be understood from a description of its manufacture. A cylindrical bar stock is drilled to form the longitudinal bores 40A and 40B. One end of the bar stock is threaded at 40C for attachment to the lower housing part 42. The section of the bar stock above the length of the side pocket bore 40B is reduced in diameter and threaded at 40D to provide for a threaded attachment to the body pipe part 38. The diameter of the upper part of the bore 40B is enlarged. A crescent shaped latch 40E is located in the enlarged bore portion. Then the bar stock is cut away in a lengthwise direction between the bores 40A and 40B from the upper end of the housing part 40 to the thread at 40D. The connecting material between the enlarged bore and the transverse cut away surface 40H is cut away to define a generally "U" shaped longitudinally extending groove 40F with the latch crescent 40E. The upper end of the housing part 40 is provided with a beveled surface 40G for selective operation of a kickover tool.

Figure 6:
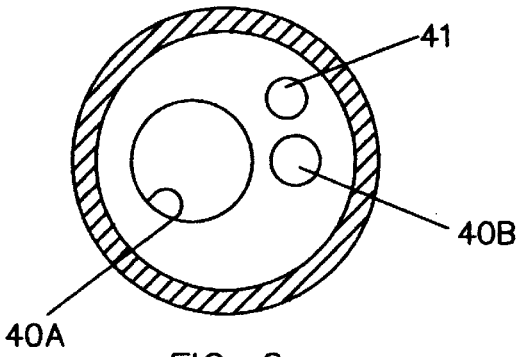
FIG. 6 is a view in cross-section taken along line 6—6 of FIG. 3.

Extending lengthwise through the housing part 40 and offset from the side pocket bore 40B and the full opening bore 40A is a conduit bore 41 which is sized to pass an electrical conductor and conduit therethrough, (See FIG. 6).

At the lower end of the side pocket bore 40B are fluid bypass ports 40J which are slots to place the bores 40A and 40B in fluid communication so that a well tool 16 can be received in the bore 40B. Also disposed in the lower end of the bore 40B is an inductive coupling probe member 45. The coupling member 45 is attached to the lower end of the bore 40B in a manner which will be described more completely in the description to follow and cooperates with a socket coupling member on a well tool.

The lower housing part 42 shown in FIG. 3 may best be described by its manufacture. A cylindrical bar stock is machined to provide a bore 42B with an internal thread for threaded attachment to the thread at 40C on the housing part 40. The bore 42B terminates at a transverse end surface 42C. The end of the bar stock is then machined to provide an internally threaded bore at 42D to receive the threaded end of a tubing pup joint 14B. An offset bore 42E which is full opening is aligned with the bore 42D. The internal end surface 42C forms an abutment. The exterior of the lower housing part 42 can be beveled (see 42F) for installation purposes in a well bore.

The lower end of the full opening bore 40A in the side pocket housing part 40 is provided with a counterbore which is sized to receive a tubular protection housing 52. The housing 52 defines the full opening bore 42A and is retained in the counterbore by engagement with the end surface 42C. It will be appreciated that the outer wall of the housing 52 and the inner wall of the bore 42B define an enclosed chamber 53 where a tubular conduit 54 attached to the inductive coupling member 45 can be positioned and passed upwardly through the conduit bore 41.

Again referring to FIG. 3, the upper body part 38 is a tubular member with an internal bore 38A and an enlarged lower bore 38B which is internally threaded at its lower end at 38C. The lower end of the part 38 is threadedly coupled to the thread 40D of the housing part 40. When assembled, the bore 38B receives the upper cut away portion of the housing part 40, (See FIG. 6).

Figure 9:
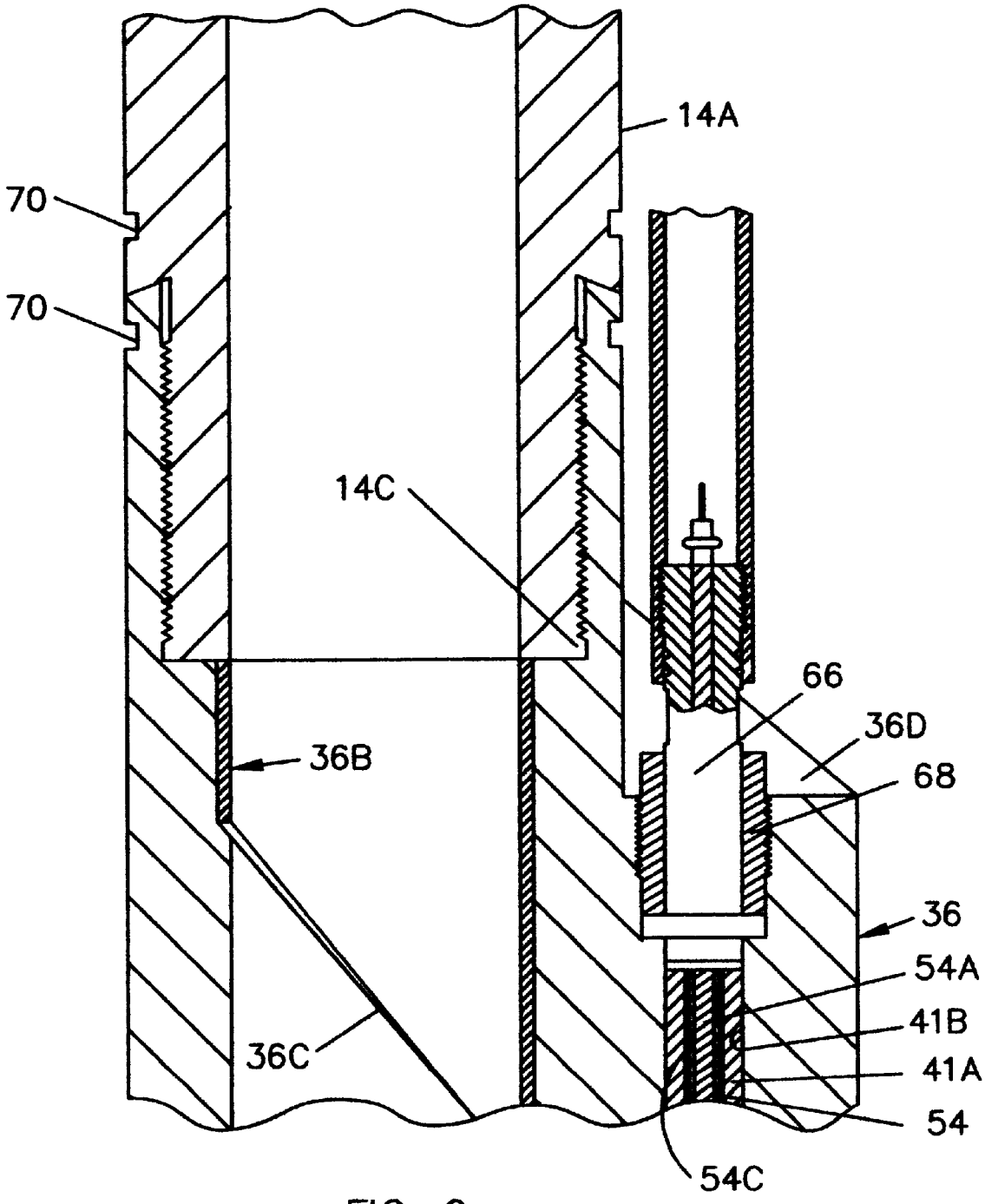
FIG. 9 is a view in partial longitudinal cross-section through a pressure coupling at the upper electrical take out.
Figure 10:
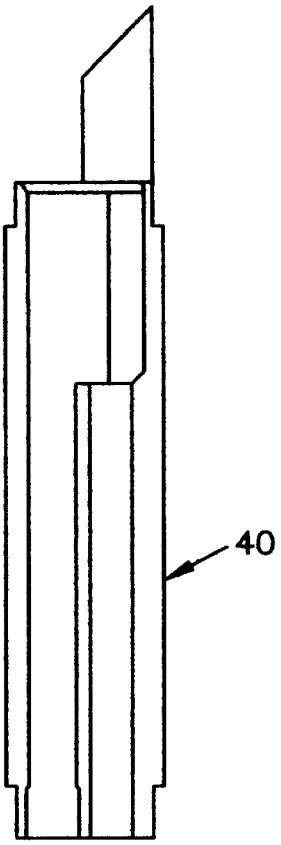
FIGS. 10–15 are schematic views in longitudinal cross-section to illustrate one form of construction of a side pocket mandrel embodying the present invention.

The take out part 36 is made from a cylindrical bar stock and has a lower outer threaded section on a reduced diameter portion of the part 36 which threadedly receives the threaded bore of the part 38 for a complimentary fit. The central portion of the part 36 has an offset enlarged bore which receives a tubular deflector 36B. The tubular deflector 36B has guide means 36C which guide a kickover tool for orientation relative to the offset pocket bore 40B. The upper end of the part 36 has an offset internally threaded bore for threadedly receiving a tubing sub 14A. The tubing sub 14A engages the deflector 36B which is locked in rotative position by a locking key 14C, (See also FIG. 9). The upper end of the part 36 has a recess 36D in which a take out connector 56 is located. The takeout connector 56 has an extension conduit 54A which is coupled to the connector or conduit 54 from the inductive coupling member 45 at a well connection 54C. In the open space between downwardly facing shoulder on the part 36 and the upper surface of the part 40, a tubular pipe member 41A extends longitudinally between the bore 41 (FIG. 4)in the part 40 and a bore 41B in the part 36 (FIG. 9). The pipe member 41A protects and encloses the tubular conduit 54 with respect to the open space.

The threaded joints between parts 36,38,40, and 42 are sealed.

Figure 11:
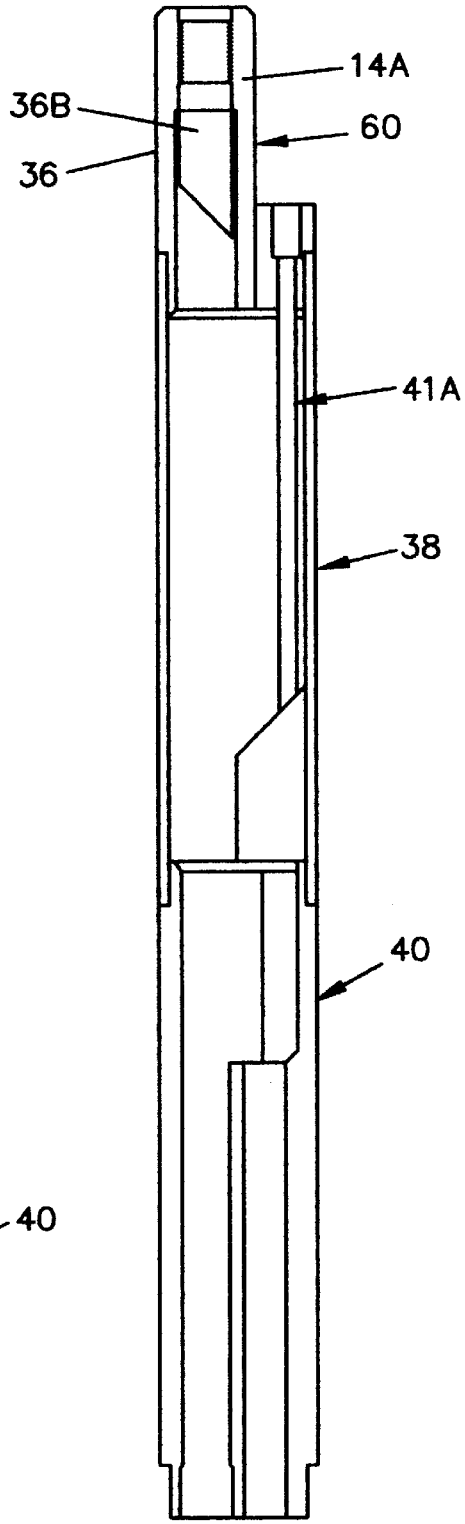
Figure 12:
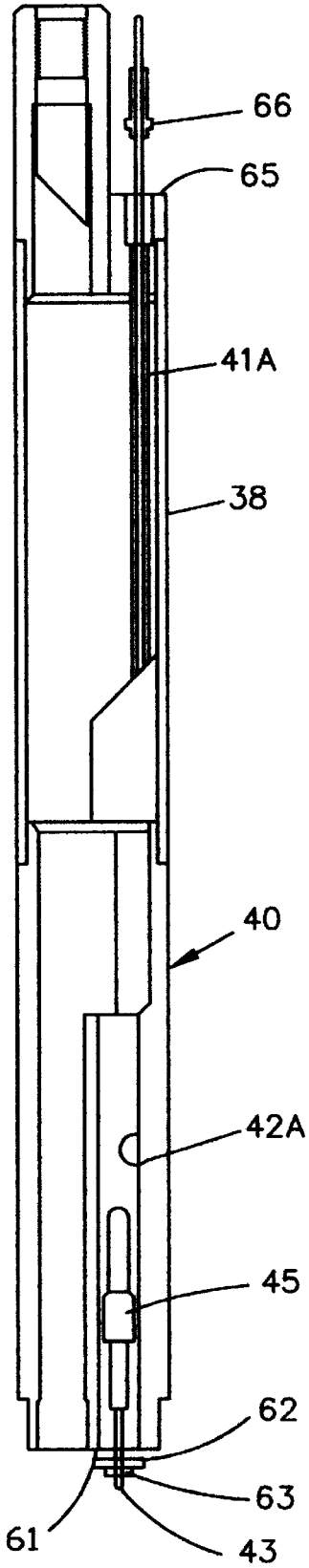
Figure 13:
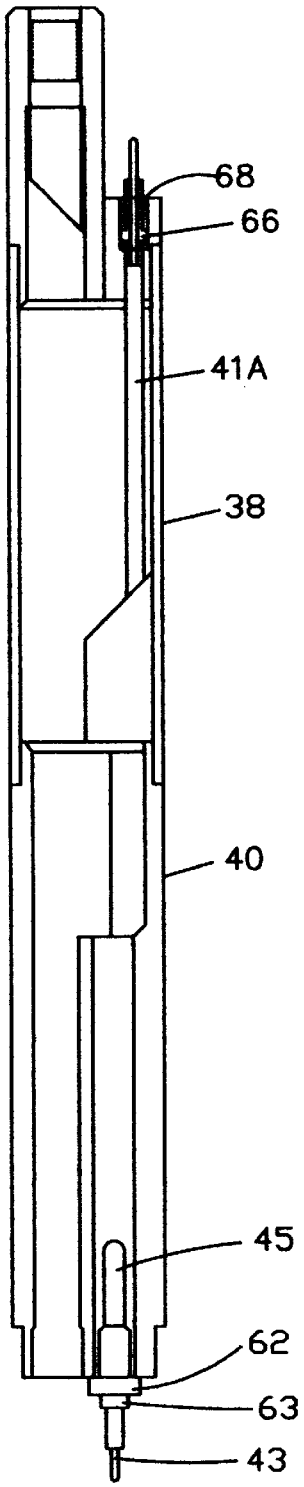
Figure 14:
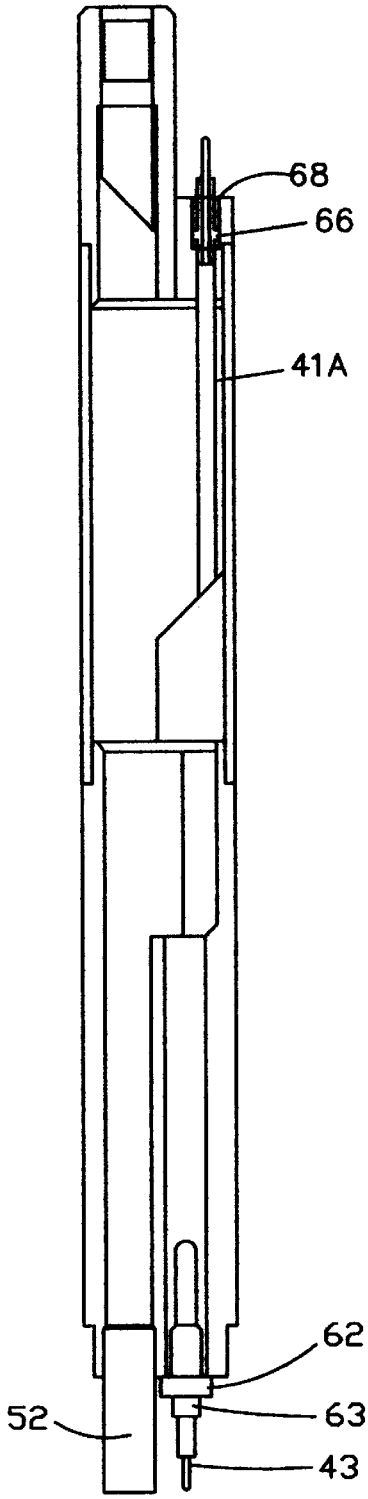
Figure 15:
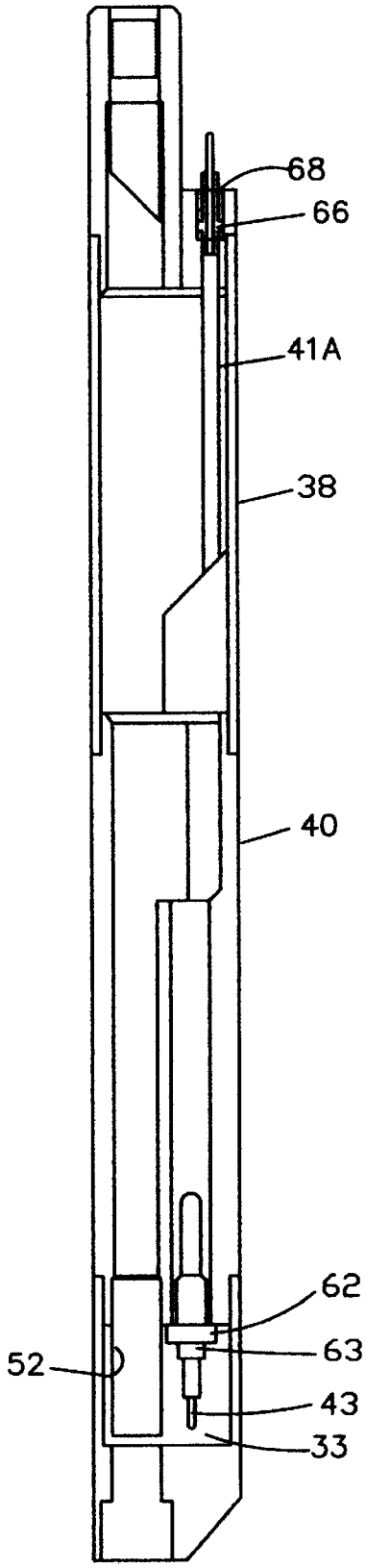

Referring now to FIGS. 10–15 and one form of manufacture of the mandrels 15 of the present invention, after the parts 36, 38, 40, 42 are machined as described, the assembly begins with part 40 (FIG. 10) with respect to the upper housing part 36, the deflector 36B is inserted and positioned in the part 36 and the tubing joint 14A attached thereby to form a subassembly 60. The pipe part 38 is threadedly connected to the side pocket part 40. The subassembly 60 is then threadedly connected to the part 38 and the bores 41B and 41 are aligned. The pipe 41A is inserted through the bore 41B and seats in a counterbore in the bore 41 in the side pocket part 40. (FIG. 11). Next, the inductive coupling member 45 is inserted into the side pocket bore 42A to a location above the lower end 61 of the side pocket bore 42A. The inductive coupler 45 is attached to a metal pliable tubular conduit 43 which passes through a seat 63 and lock nuts 63. The conduit 43 extends downwardly from the inductive coupler 45 and is curved in a "U" shape to extend upwardly through the bore 41, the pipe conduit 41A and the bore 41B to a location above the upper end of the upper housing part 38. The extension of the conduit 43 above the upper end 65 of the part 38 is about the same as the distance the coupling member 45 is located up above the lower end 61 of the side pocket bore 42A. A single wire conductor is disposed within the conduit 43 for data communication purposes. At the upper end of the conduit 43, the single wire connector is coupled to a pressure sealing device such as a "Kemlon" connector 66. The connector 66 is welded or bonded to the conduit 34 (See 54C, FIG. 9) while the single wire conductor is attached to a coupling pin on the connector 66. A tubular lock nut 68 (See FIG. 9) is slid over the end of the connector 66. The connector and the inductive coupling member 45 are simultaneously lowered to a position where the inductive coupling member 45 is in the lower end of the side pocket bore 42A of the part 40 and the lock nut 68 is threadedly coupled to a threaded bore in the part 36 to lock the connector 66 and the pipe 41B in a fixed position. (See FIG. 13). The inductive coupling member 45 at the lower end of the side pocket bore 42A is secured to the seat 62 by the attachment nuts 63, (See FIG. 17). Next, the protective sleeve 52 is inserted into the side pocket part 40 and the lower housing part 42 is threadedly attached to the side pocket part 40 to enclose the conduit 43 in the chamber 33. The sleeve 52 fixes the seat 62 relative to the side pocket part 40. The side pocket mandrel can be thus constructed and assembled without requiring any heat treatment.

While threaded and sealed connections are suitable in some instances there is a reluctance to utilize a side pocket mandrel which is not welded pressure tight. As shown in FIG. 9, the threaded parts are provided with outer annular weld grooves 70 adjacent to the facing connections. With this arrangement the cylindrical configuration can be easily welded at the junction of the facing connection without requiring heat treatment.

Figure 16:
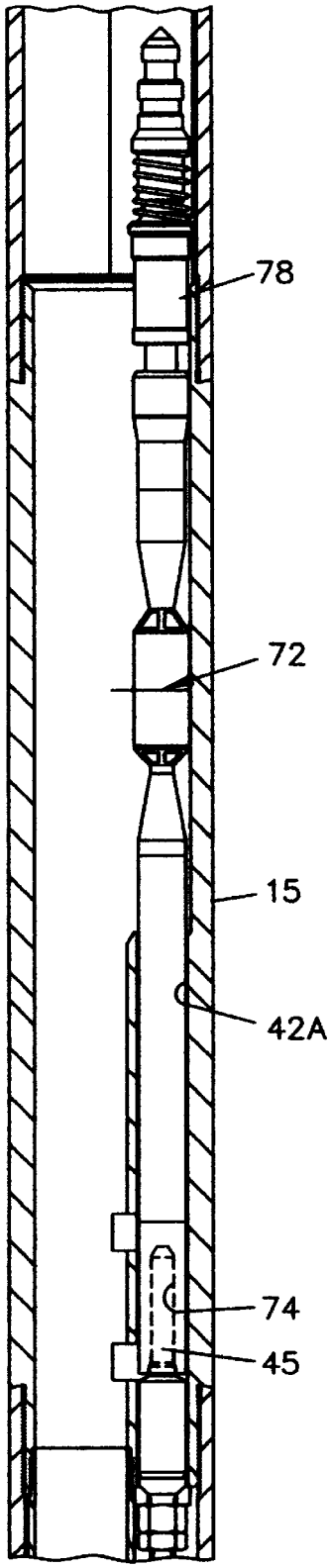
FIG. 16 is a view in partial cross-section of a flow meter which can be utilized with the present invention.

Referring now to FIG. 16 a side pocket mandrel 15 is illustrated with a flowmeter 72 in the side pocket bore 42A. The flowmeter 72 may be of the type illustrated in U.S. Pat. No. 5,463,903 issued Nov. 7, 1995. The flowmeter 72 has an inductive coupling socket 74 while seats on an inductive coupling probe member 45. The flowmeter 70 is attached to a latching mechanism 78 which is conventional. Thus, use of a flowmeter can be made in a side pocket mandrel.

Figure 17:
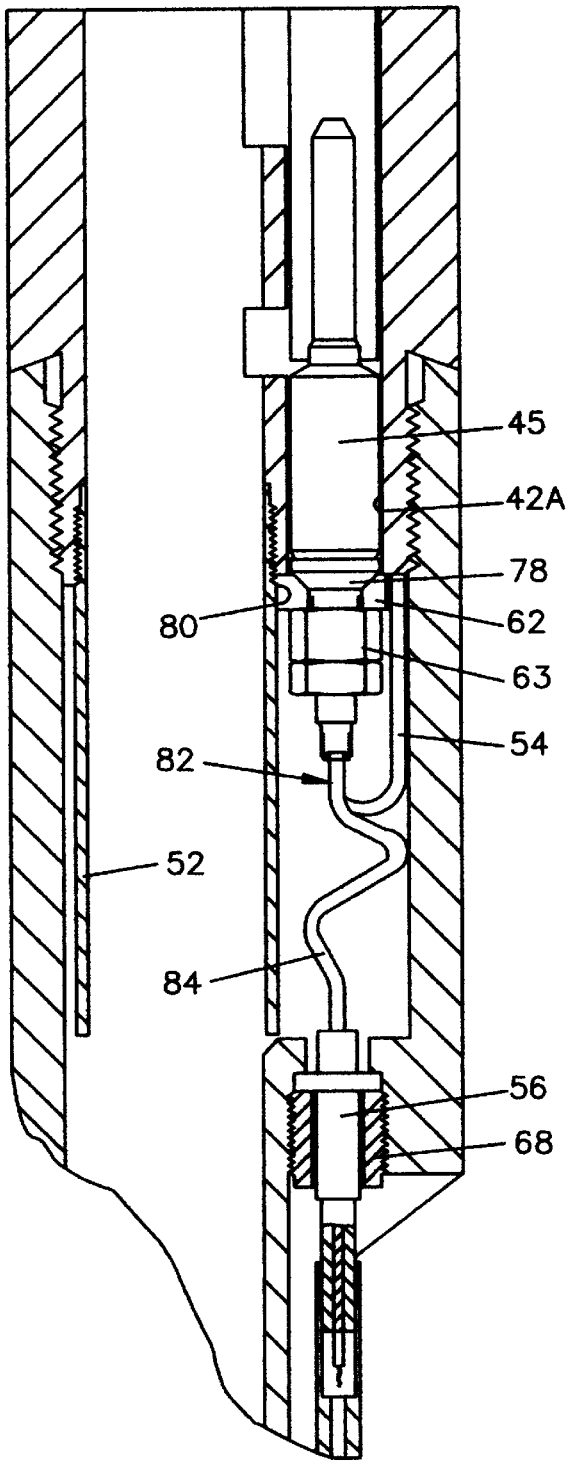
FIG. 17 is a view in partial cross-section through another form of the present invention.

Referring now to FIG. 17, the inductive coupling member 45 is slidably received in the lower end of the side pocket bore 42A, the coupling member 45 has a tapered seat portion 78 which seats in a ring member seat 62. The protective pipe 52 has a reduced diameter section 80 located so as to engage and fix the ring member seat 62 relative to the offset pocket bore 42A. In FIG. 17 the conduit 54 includes a "Y" connection 82 which permits a conductor wire conduit 84 to be connected to a pressure connector 56 and thus provide continuity to a lower side pocket mandrel installation.

Figure 18:
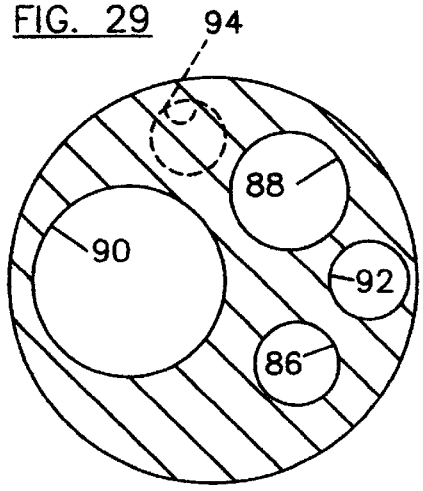
FIG. 18 is a transverse cross-section to illustrate another form of the present invention.

Referring now to FIG. 18, a side pocket mandrel can have side by side offset pocket bores 86, 88 for respectively different well tools such as a pressure temperature gauge tool and a flowmeter tool or two pressure gauges. The bores 86, 88 are offset from a full opening bore 90. The electrical conduits for the well tools can be combined with a "Y" connection similar to that described with respect to FIG. 17 and passed through a single bore 92. Alternately, a second bore 94 (shown in dashed line) can be provided. Similarly, the take out housing can be modified to have an internal or external "Y" connector or two electrical take-outs. It will also be appreciated that more than one electrical wire can be utilized with the present invention.

With respect to use of the side pocket mandrel with inductive coupling well tools and data transmission, reference is made to U.S. patent application Ser. No. 08/114,059 filed Oct. 23, 1993, now U.S. Pat. No. 5,457,988, and to U.S. patent application Ser. No. 08,358,704, filed Dec. 19, 1994, now U.S. Pat. No. 5,455,573, issued Oct. 3, 1995.

Figure 19:
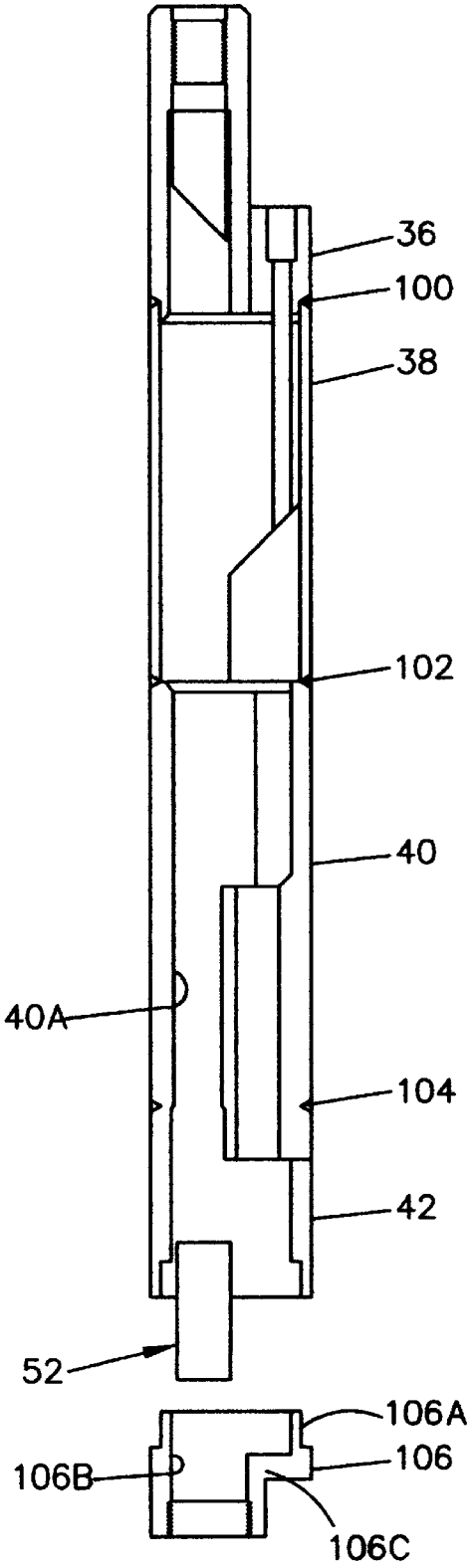
FIG. 19 is a schematic view of another form of the invention.

In another form of construction, instead of threaded connectors between the parts (for example, as shown in FIG. 19) parts 36, 38 and 40 can be butt welded at locations 100, 102 and 104. The lower end 106 has a cylindrical section 106A which can be threaded into an open end on the lower part 42 so that an offset bore 106B aligns with the fill opening bore 40A through the mandrel. An end wall 106C can be provided with a connector bore as described with respect to FIG. 17.

With the forgoing system, it will be appreciated that a single wire conduit system can be utilized with multiple side pocket mandrels where conventional electrical accessing protocols can be used to address and control individual tools or units in a respective side pocket mandrel.

Figure 20B:
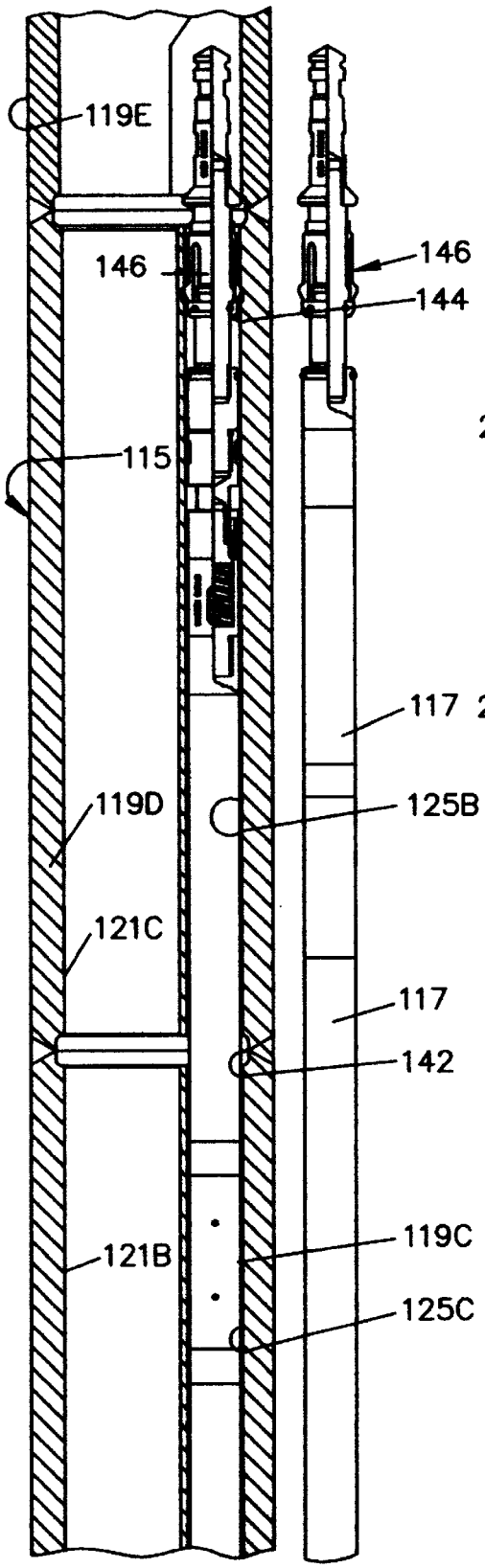
FIG. 20A–FIG. 20D are end to end views in partial cross section of a welded form of the tool.
Figure 20A:
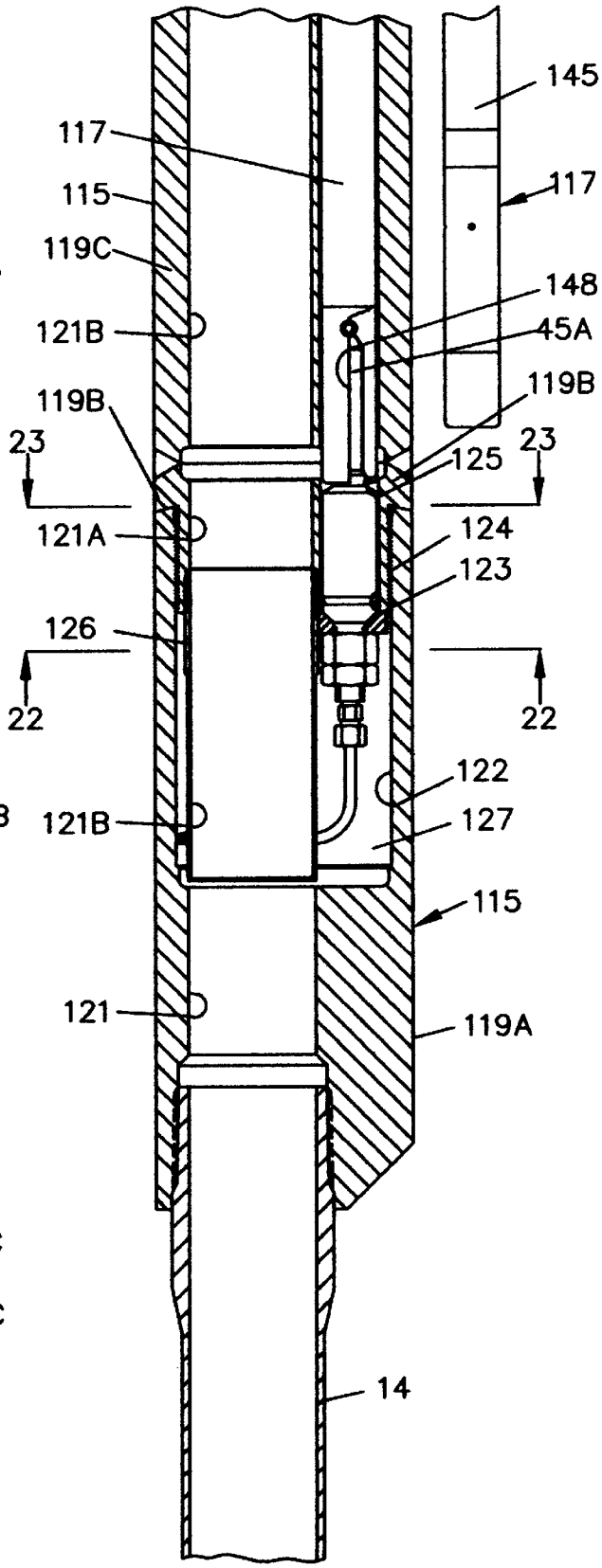
Figure 20C:
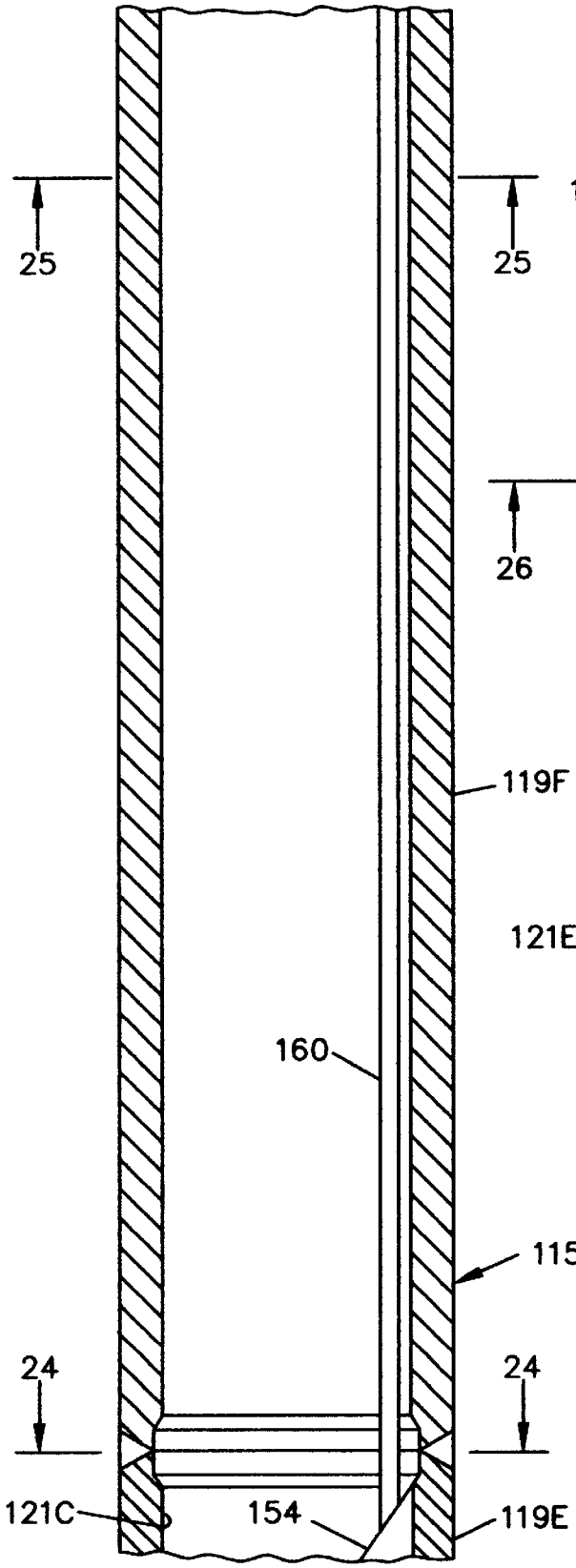
Figure 20D:
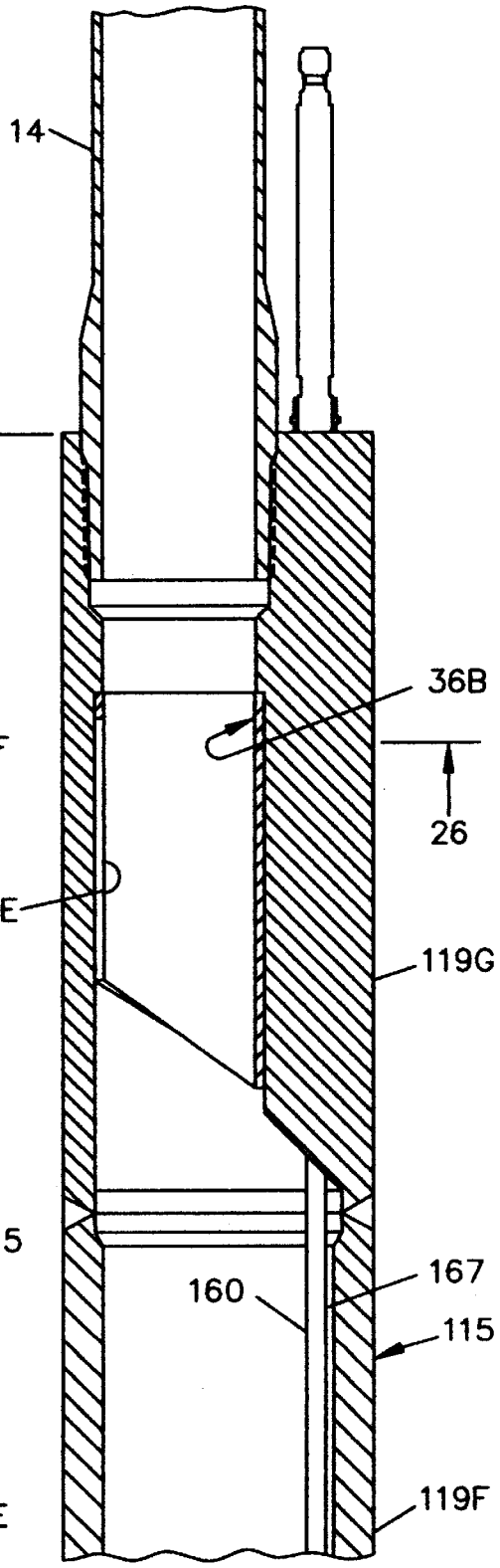
Figure 26:
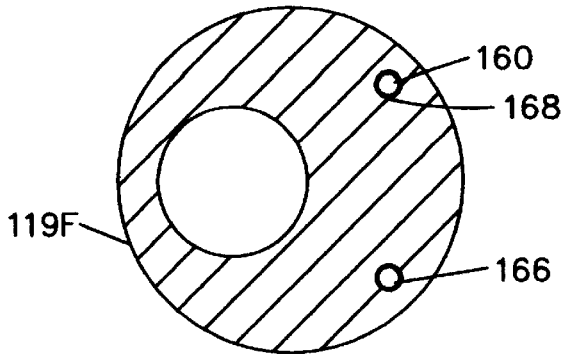
FIG. 26 is a view in cross section taken along line 26—26 of FIG. 20D (lines may be omitted for clarity of presentation)

Referring now to FIGS. 20A–20D, a preferred mode of a side pocket mandrel 115 is illustrated from a bottom end in FIG. 20A to a top end in FIG. 20D for connection in a string of tubing or production tubing 14 so as to form part of the string of tubing. In FIGS. 20A and FIG. 20B a retrievable pressure gauge 117 is illustrated within the side pocket mandrel and also separately to the right of the side pocket mandrel.

The side pocket mandrel 115 is generally an elongated cylindrically shaped member formed by a number of sections or parts 119*a*–119*g*. These various parts 119(*a*–*g*) are made in various lengths for manufacturing and assembly. As will be apparent from the disclosure to follow, the parts are simple to construct and assemble for alignment of the various bores.

The lowermost housing part 119*a* ( see FIG. 20A, FIG. 21, FIG. 22) is cylindrical in cross section and is connectable to a string of pipe or tubing 14 and has an offset full opening bore 121 which is in alignment with the bore of the tubing 14. An enlarged bore 122 in the upper end of the housing part 119*a* has an internal thread 123 which threadedly and seingly couples to an external thread 124 on a connector housing 119*b*. The bore 122 is located about a central axis for the housing part 119*a*.

The connector housing part 119*b* has a side by side located offset pocket bore 125 and a full opening bore 121*a*. The full opening bore 121*a* has an enlarged bore portion 126*a* to receive a tubular protection member 126 which has a full opening bore 121*b* and which extends to a juncture proximate to the bottom surface of the enlarged bore 122. The tubular protection member 126 effectively provides a chamber 127 within the enlarged bore 122. The housing part 119*b* also has a lengthwise extending bore 140 which aligns with a bore in a plate member 132 for passage of a tubular line conduit as win be explained hereinafter. The upper end of the housing part 119*b* has an exterior chamfered edge 129 for exterior welding and an interior recess 130 in the wall for fluid access. Prom the forgoing description, it can be seen that the housing part 119*a* and the housing part 119*b* are easily machined and connectable.

Disposed in the offset pocket bore 125 of the housing part 119*b* is an inductive coupling member 45 with an upwardly extending probe 45*a* which is centered in the bore 125. The lower end of the coupling member 45 has a tapered surface to seat in a tapered surface of an opening in the plate member 132. The plate member 132 is semi circular (see FIG. 22 )and is bolted by bolts 134 to the housing part 119*b*. A nut connection 135 attaches the coupling member 45 to the plate member 132. The coupling member 45 has a flexible tubular line 43 for an electrical conductor and the tubing line 43 is containable within the chamber 127 and can pass between the wall of the protection member 126 and the wall of the bore 122 before passing into the opening in the plate member 132 and through the longitudinally extending bore 140 in the part 119*b* to extend to the upper end of the side pocket mandrel. The flexibility of the tubular line member 43 and the capacity of the chamber 127 to contain the tubular line member 43 assists in the assembly as will hereinafter be more apparent.

Figure 21:
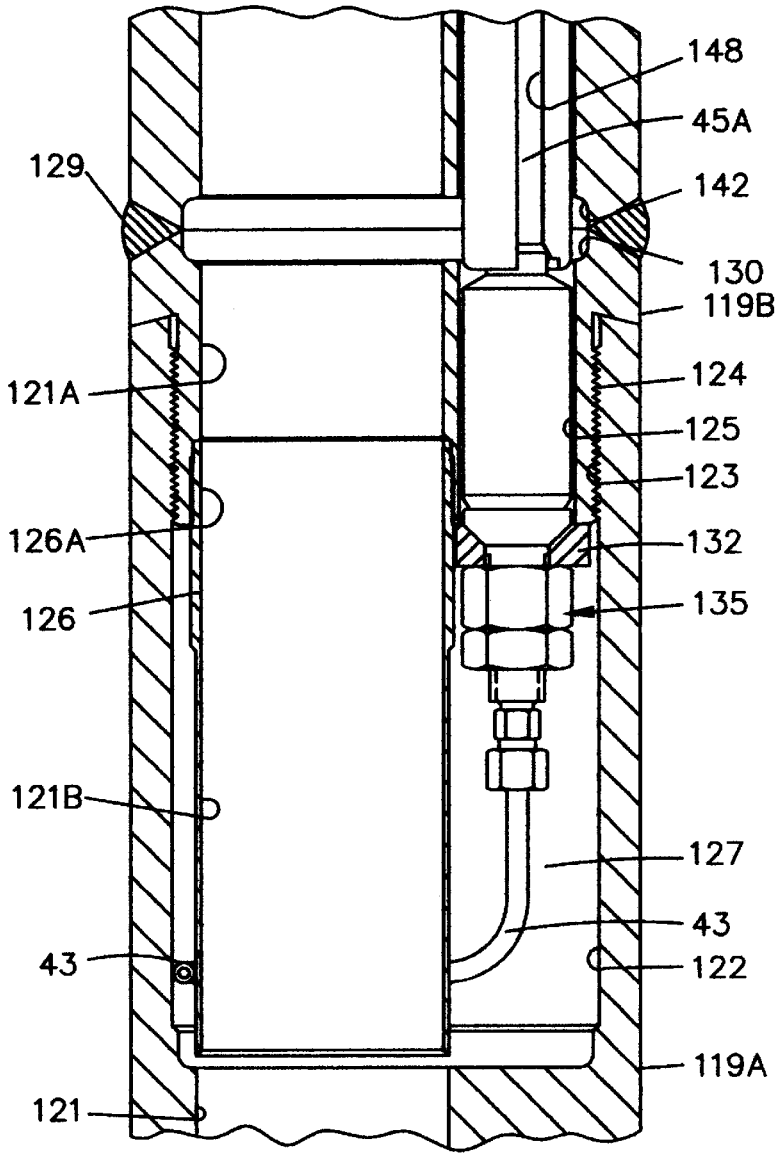
FIG. 21 is an enlarged partial view in cross section illustrating a detail of the present invention.
Figure 22:
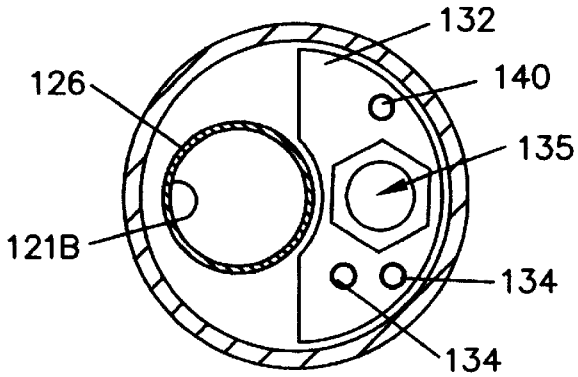
FIG. 22 is a view in cross section taken along line 22—22 of FIG. 20A (lines may be omitted for clarity of presentation)

Connecting part 119*c* is cylindrical with three longitudinally bored openings to define the full opening bore 121*b*, the side pocket bore 125*a* and the a bore (not shown) for the tubular line 43 which is aligned with the tubular member bore 140 in the part 119*b* and with the opening in the plate member 132. As can be appreciated, the machining of this part 119*c* is straightforward in drilling three holes. The ends of the connecting part 119*c* are provided with exterior chamfered bevels and interior wall recesses as discussed before so that the parts 119*b* and 119*c* and the parts 119*c* and 119*d* can be aligned and welded to one another while leaving interior wash out pockets 142 at the welded joints. A washout pocket provides a clear opening fluid access between the full opening bore and the side pocket bore. As shown in FIG. 21, the washout pocket is located at the bottom of the side pocket bore 125*a* which is the location for the coupling member 45.

The connecting part 119*d* (FIG. 20B) is similar to connecting part 119*c* with a full opening bore 121*c*, a side pocket bore 125*c* and a tubular member bore (not shown) except at the upper end of the offset pocket bore 125*b*, internal latching recesses 144 are provided for the side pocket tool. The tubular member bore is aligned with the tubular member bore 140.

As shown in FIGS. 20A and 20B, a side pocket tool 117 such as a pressure and temperature gauge is sized to be retrievable received in and retrieved from the side pocket bore. At the upper end of the tool 117 is a conventional latching mechanism for releasably coupling to the side pocket bore latch recess 144. At the lower end of the tool 117 is an inductive coupling member with a socket 148 to receive the probe 45*a* in the side pocket bore. Pressure in the well bore is sensed by the tool 117 and transmitted to the earth's surface via an electrical conductor connected to the probe 45*a*.

Figure 25:
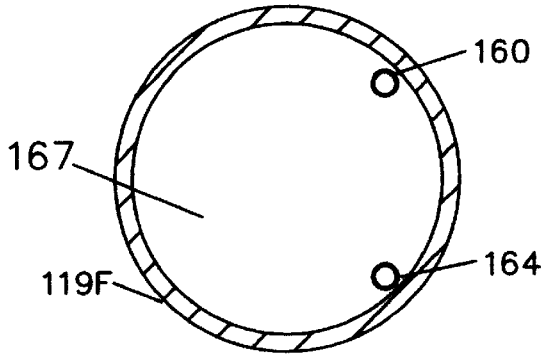
FIG. 25 is a view in cross section taken along line 25—25 of FIG. 20C (lines may be omitted for clarity of presentation)
Figure 24:
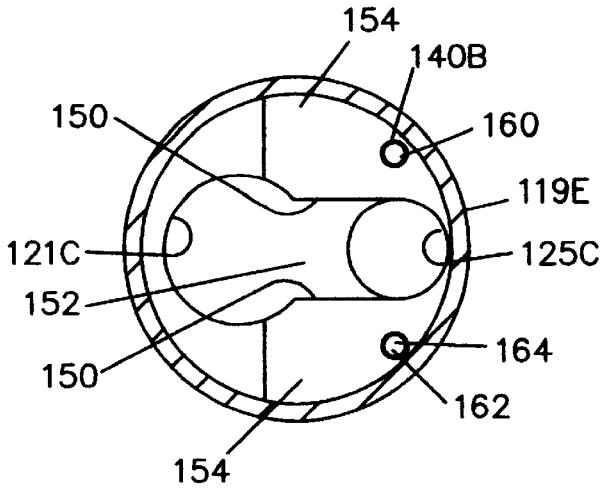
FIG. 24 is a view in cross section taken along line 24—24 of FIG. 20C (lines may be omitted for clarity of presentation)
Figure 23:
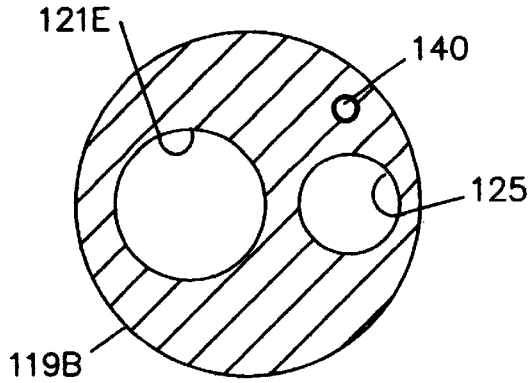
FIG. 23 is a view in cross section taken along line 23—23 of FIG. 20A (lines may be omitted for clarity of presentation)

Connecting housing part 119*e* (FIG. 20B, FIG. 20C, FIG. 23) has a full opening bore 121*c* and a side pocket bore 125*c* where the full opening bore 121*c* and the side pocket bore 125*c* are connected to one another by an opening 152 defined by parallel walls 150 which are spaced apart by a distance equal to the diameter of the side pocket bore 125*c*. The opening 152 permits the tool 117 to enter the side pocket bore. To facilitate the entry of a tool the upper surfaces of the walls 150 are beveled at 154. The part 119*e* has a connecting tubular member bore 140*b* which is sized to receive a tubular protection pipe 160. In transverse alignment position with the connecting bore 140*b* is a second pipe bore 162 arranged so that the bore 140*c* and the bore 162 straddle the central axis for the side pocket bore 125*c* and are disposed slightly more toward the central axis of the part 119*e*. The bore 140*b* and the bore 162 respectively receive two pipe members 160 and 164 which provide a longitudinally extending parallel guide recess for guidance of the tool by the side kicker to position the tool for alignment in the side pocket bore. This is illustrated more clearly in FIG. 25.

The part 119*f* (FIG. 20C and FIG. 20D) is merely a tubular member which has beveled exterior ends with interior recesses for the washout function as described heretofore and defines an upper recess 167 which provides open communication with a full opening bore through the housing.

The top housing part 119*g* (FIG. 20D) is cylindrically shaped with an offset bore with a tubular deflector 36B which provides a full opening bore 121*e*. The upper end of the housing part 119*g* has an offset bore which is threaded for connection to a string of tubing 14. In the solid section of the part 119*g* is a blind bore 166 to receive the dummy alignment pipe 164 and a through bore 168 to align with the bore 140 for the tubular member 43 and to receive the upper end of the pipe member 160. The upper end of the part 119*f* with the threaded bore 168 is shown and described with respect to FIG. 27.

Figure 29:
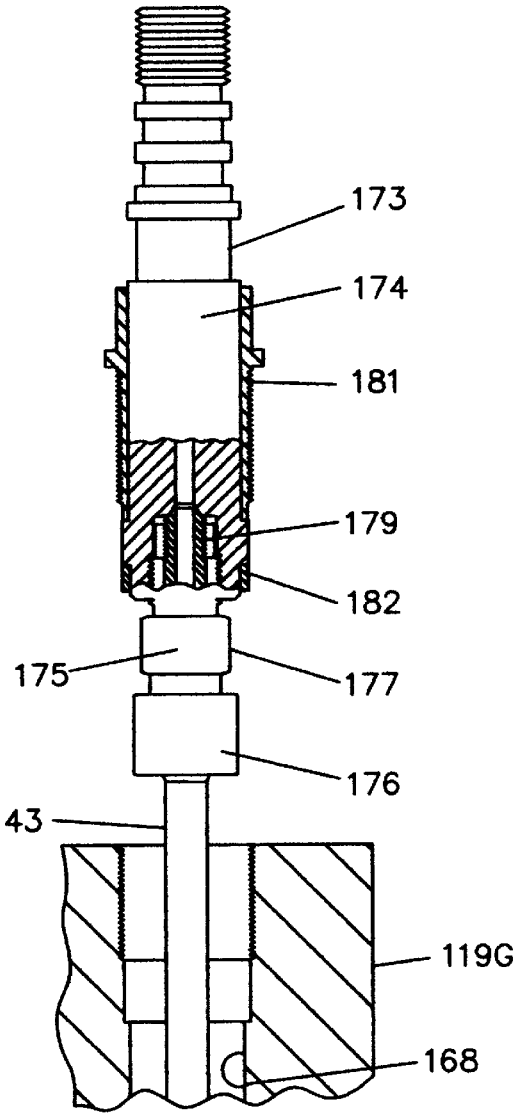
FIG. 29 is a partial view in cross-section of the top part when the inductive coupler is in the position shown in FIG. 28.
Figure 27:
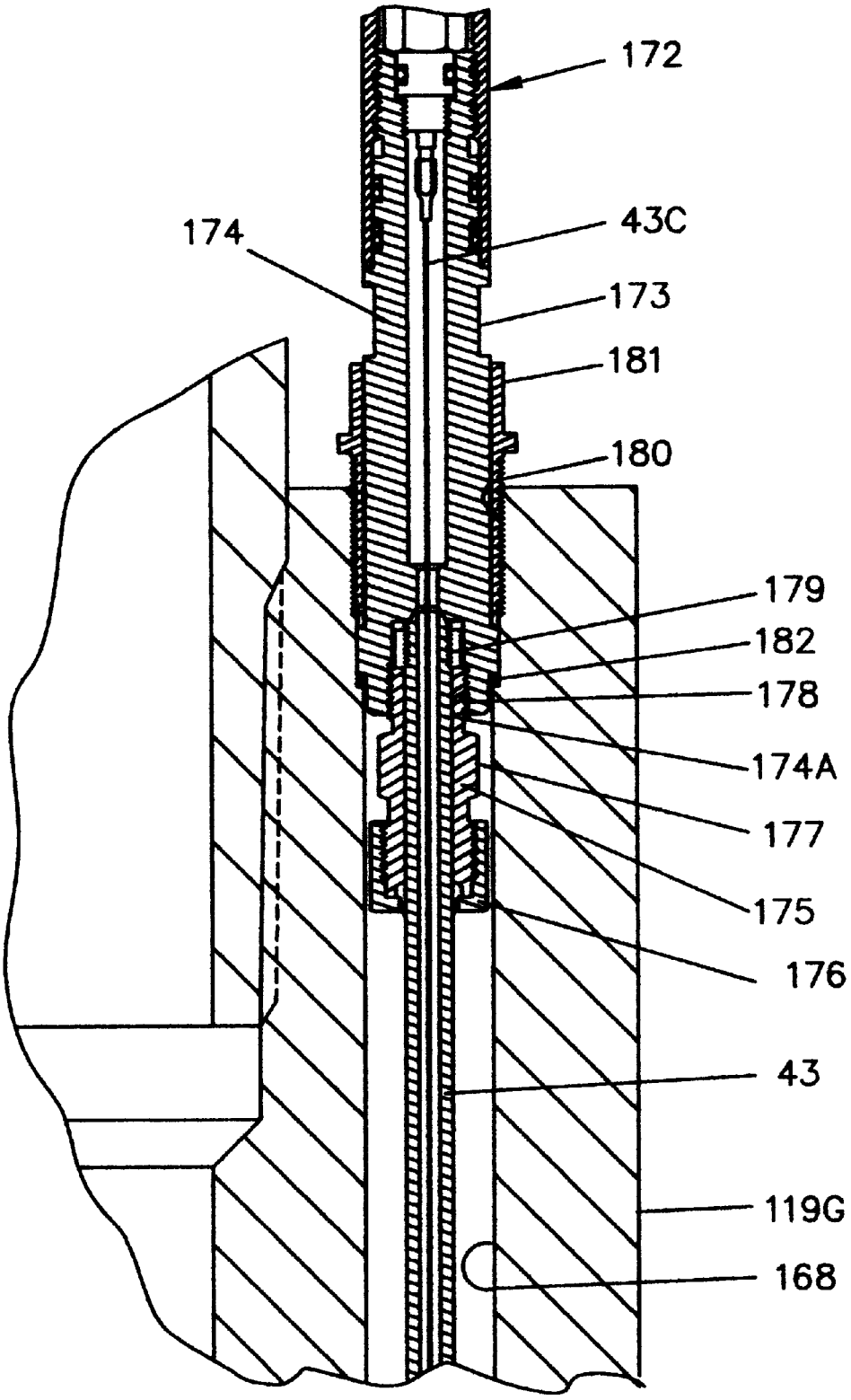
FIG. 27 is a partial view in cross-section of the connection at the top part.
Figure 28:
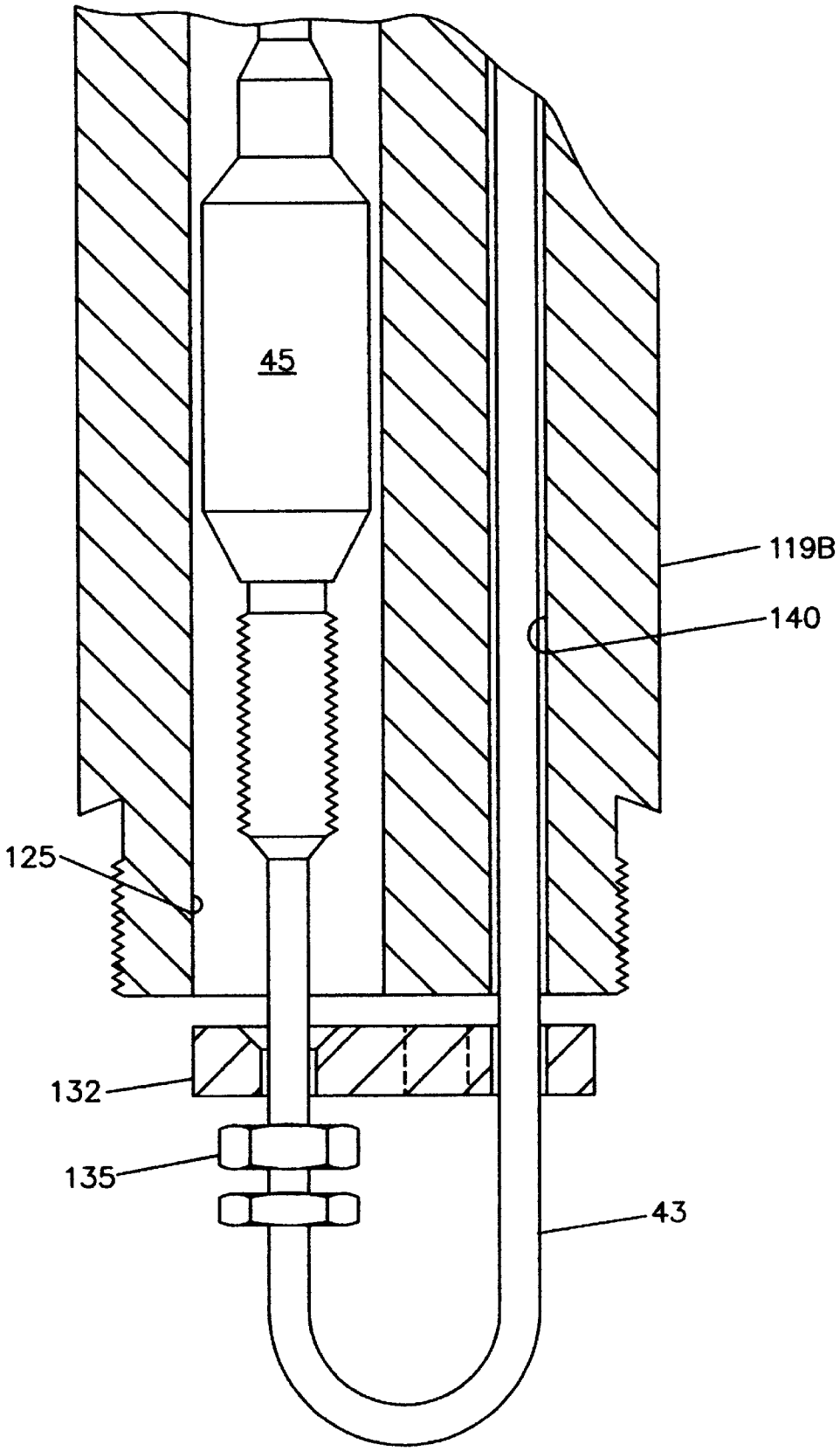
FIG. 28 is a partial view in cross-section of the inductive coupler position relative to the conduit position in an assembly mode.

Referring now to FIG. 27, a partial detail in cross-section of the take out connection in the top head part 119*g* is illustrated and in FIGS. 28 and 29, upper and lower portions of the mandrel are shown in partial cross-section to illustrate a part of the assembly procedure.

In FIG. 27, the through bore 168 in the top part 119*g* receives the tubular electrical conduit member 43 containing the electrical conductor 43*c* which is connected to a "Kemlon" connector 172. The "Kemlon" connector 172 has wrench flats 173 and a lower body portion 174 with a lower threaded bore 174*a* and a downwardly facing tapered seating seat which engages the upper end of the tubular conduit member 43. A tubular connector member 175 together with an autoclave sealer cap 176 are slidably received on the end of the tubing member 43 when it is initially projected exterior to the top part 119*g* in assembly. The connector member 175 has wrench flats 177 and an external threaded portion 178. The tubing member 43 projects through the connector member 175 and has an external left hand thread to receive a locking nut 179. The body portion 174 has a lower bore portion with an internal thread which receives the nut 179 on the end of the tubular conduit 43. The wrench flats 175 and 173 permit the body portion 174 to be threadedly connected to the connector member 175 and the end of the tube conduit 43 can be engaged with the beveled seat in the body portion 174.

The upper end of the through bore 168 has an internal thread 180 to threadedly receive a tubular retainer 181. Disposed between a shoulder on the tubular retainer and a shoulder in the through bore 168 is a recess which receives an annular copper ring 182. The metal ring 182 is compressed when the retainer is threaded into the bore 168 to provide a fluid tight seal for the pressure connector.

Referring to FIG. 28 and FIG. 29, a portion of the assembly steps is illustrated. As shown in the drawings when the inductive coupling member 45 and the attached tubular conduit 43 are respectively moved upwardly in the side pocket bore 125 and the bore 140 (FIG. 28), the tubular conduit 43 is located exterior of the through bore 168 in the top housing part 119*g* (FIG. 29). When the end of the tubing conduit 43 is exterior to housing part 119*g* the autoclave cap 176 and the connector member 175 are located on the end of the tubing 43. The copper sealing ring 182 is placed on the body portion 174 and the conductor wire in the tubing 43 is connected in the "Kemlon" connector. The body portion 174 is now held stationary and the connector member 175 is threadedly attached to the body portion 174. The connected assembly is then lowered to a final position which also lowers the inductive coupling member 45 to a final position. The retainer 181 is slid over the body portion 174 and screwed into the top part 199*g* which provides a metal to metal seal 182 in the bore 168. At the lower end of the side pocket mandrel, the inductive coupler 45 is attached to the plate 132 and the plate 132 is attached to the housing part.

From the forgoing description it can be appreciated that the side pocket mandrel is constructed principally from cylindrical shaped outer parts with bores where necessary to define a full opening bore through the parts, a offset pocket bore, and a tubular member bore for passage of a tubular member and having adjacent ends with exterior weld chamfers and interior wall recesses to provide fluid access openings between the full opening bore and the offset pocket bore. The simplicity of manufacture permits the alignment of access openings with adjacent parts and eliminates heat treating because the exterior welding can be accomplished with affecting the strength of the materials.

It will be apparent to those skilled in the art that various changes may be made in the invention without departing from the spirit and scope thereof and therefore the invention is not limited by that which is disclosed in the drawings and specifications but only as indicated in the appended claims.

What is claimed is:

1. A side pocket mandrel for use with a tubing string in a well bore traversing earth formations including:

an elongated side pocket housing having a full opening bore located along a longitudinal axis for said housing, said side pocket housing having (1) a laterally offset upper recess in open communication with said full opening bore for receiving a well tool moved laterally from said full opening bore, and (2) a lower laterally offset pocket bore in said housing for receiving said well tool;

said side pocket housing having at least one laterally offset, longitudinally extending and separately located pipe bore extending through said side pocket housing alongside of said offset pocket bore for connecting said upper recess to a lower recess below said offset pocket bore;

said side pocket housing having at least one longitudinally extending outlet bore extending between said upper recess and the exterior of the side pocket housing at its upper end;

at least one pipe member extending through said upper recess between said outlet bore and said pipe bore;

a communication coupling member disposed in the lower end of the pocket bore for communication with said well tool, said coupling member having a connecting electrical conduit extending into the lower recess and through the pipe bore and the pipe member to the outlet bore.

2. The apparatus as set forth in claim 1 wherein said lower recess is within the body of the side pocket mandrel and further including a tubular member disposed in the lower end of said housing and defining a portion of said full opening bore and enclosing said lower recess to define a chamber enclosing the portion of the electrical conduit disposed within said lower recess; and a pressure connector disposed in said outlet bore for coupling said electrical conduit to an external wire connector.

3. The apparatus as set forth in claim 1 wherein said housing includes separate cylindrically shaped parts connected together where some of the parts define the full opening bore, the offset pocket bore and the pipe bore.

4. The apparatus as set forth in claim 3 wherein some of the parts have exterior bevels for welding and have interior recesses for providing a fluid access area.

5. The apparatus as set forth in claim 1 wherein said housing has second aligned pipe bores located in facing surfaces of said first recess for receiving a second pipe member where said second pipe bores and said second pipe member and the one pipe member are aligned and respectively located on either side of a central axis for said side pocket bore with a spacing to enhance the guidance of said well tool into said side pocket bore.

6. The apparatus as set forth in claim 1 and further including more than one offset pocket bore for retreivably receiving a second well tool.

7. The apparatus as set forth in claim 1 and further including a longitudinally extending bottom outlet bore extending between said lower recess and the exterior of the side pocket housing for receiving an electrical conduit extending from the lower recess, and a second pressure connector disposed in said bottom outlet bore for coupling said electrical conduit to an external wire connector.

8. The apparatus as set forth in claim 1 wherein said housing includes (1) an upper head part defining an upper end surface of the upper recess and defining at least a full opening bore and an outlet bore, (2) an intermediate tubular part for defining said upper recess, (3) a guide member part having a section of the pipe bore, a section of the offset pocket bore and a section of the full opening bore where said section of the full opening bore and said section of the offset pocket bore are open to one another by parallel wall surfaces spaced to guide a well tool into the section of the side pocket bore, (4) an upper offset pocket part having another section of the full opening bore, an upper section of the offset pocket bore and a section of the pipe bore, (5) a lower offset pocket part having still another section of the full opening bore, a lower section of the offset pocket bore and a section of the pipe bore, (6) a coupling part having still another section of the full opening bore, a section of the offset pocket bore and a section of the pipe bore and further having an external coupling threaded section, (7) a bottom member part with a tubular recess having an internal threaded section for threaded coupling with said coupling part and for defining the lower recess, said bottom member part having a section of the full opening bore located offset from the central axis of the bottom member part, said parts (1) through (6) having facing end surfaces with outer weld bevels and inner wall recesses whereby fluid wash areas are provided at each connection and fluid communication is provided between parts (4) and (5) and between parts (5) and (6) for providing fluid access to the offset pocket bore.

9. The apparatus as set forth in claim 8 wherein said housing has second aligned pipe bores located in facing surfaces of said first recess for receiving a second pipe member where said second pipe bores and said second pipe member and the one pipe member are aligned and respectively located on either side of a central axis for said side pocket bore with a spacing to enhance the guidance of said well tool into said side pocket bore.

10. The apparatus as set forth in claim 9 and further including more than one offset pocket bore for retreivably receiving a second well tool.

11. The apparatus as set forth in claim 10 and further including a longitudinally extending bottom outlet bore extending between said lower recess and the exterior of the side pocket housing for receiving an electrical conduit extending from the lower recess, and a second pressure connector disposed in said bottom outlet bore for coupling said electrical conduit to an external wire connector.

12. The apparatus as set forth in claim 8 and further including more than one offset pocket bore for retreivably receiving a second well tool.

13. The apparatus as set forth in claim 12 and further including a longitudinally extending bottom outlet bore extending between said lower recess and the exterior of the side pocket housing for receiving an electrical conduit extending from the lower recess, and a second pressure connector disposed in said bottom outlet bore for coupling said electrical conduit to an external wire connector.

14. The apparatus as set forth in claim 1 wherein said electrical conduit includes at it's upper end, connector means including a nut member threadedly connected to the electrical conduit and a tubular connector element with wrench flats disposed on said conduit below said nut member, and said pressure connector and said connector element having a threaded interconnection, said through bore and said pressure connector having facing surfaces for defining a sealing recess and a metal sealing ring disposed in said recess; and a tubular retainer collar disposed on said pressure connector and having a threaded interconnection with said through bore for locking said pressure connector in a sealing condition in said through bore.

15. A method for assembling a side pocket mandrel to provide a top entry electrical connection from a bottom location in the side pocket mandrel comprising the steps of:

connecting end to end a number of cylindrically shaped parts in a sequence to form an elongated side pocket housing having a full opening bore located along a longitudinal axis where said side pocket housing has (1) a laterally offset upper recess in open communication with said full opening bore for receiving a well tool moved laterally from said full opening bore, (2) a lower laterally offset pocket bore in said side pocket housing for receiving said well tool, (3) at least one laterally offset, longitudinally extending and separately located pipe bore extending through said side pocket housing alongside of said offset pocket bore for connecting said upper recess to a location below the offset pocket bore and (4) at least one longitudinally extending outlet bore extending between said upper recess and the exterior of the side pocket housing at its upper end;

while connecting said parts, locating at least one pipe member in position to extend through said upper recess between said outlet bore and said pipe bore and connect the pipe bore in said side pocket housing to said outlet bore;

connecting a communication coupling member to a flexible tubular connecting electrical conduit and passing the electrical conduit through the pipe bore to exit to the exterior at the top end of the housing (and connecting a pressure connector with an external wire connector to said electrical conduit);

affixing the communication coupling member in the lower end of the offset pocket bore.

16. The method as set forth in claim 15 including the steps of connecting parts at locations intermediate and at the lower end of the housing where the parts have exterior bevels for welding and have interior annular recesses for providing fluid access from the full opening bore to the side pocket bore.

* * * * *